United States Patent [19]

Kan et al.

[11] Patent Number: 4,557,582

[45] Date of Patent: Dec. 10, 1985

[54] MAGNET ROLL

[75] Inventors: Fumitaka Kan, Tokyo; Kimio Nakahata, Kawasaki, both of Japan

[73] Assignee: Canon Kabushiki Kaisha, Tokyo, Japan

[21] Appl. No.: 477,077

[22] Filed: Mar. 21, 1983

[30] Foreign Application Priority Data

Apr. 2, 1982 [JP] Japan ..... 57-55744
Apr. 6, 1982 [JP] Japan ..... 57-49596[U]
Apr. 6, 1982 [JP] Japan ..... 57-49597[U]

[51] Int. Cl.[4] ..... G03G 15/08

[52] U.S. Cl. ..... 355/3 DD; 355/14 D; 118/657; 430/122

[58] Field of Search ..... 355/3 DD, 14 D, 3 R; 118/657; 430/122

[56] References Cited

U.S. PATENT DOCUMENTS 4,227,796 10/1980 Kamp et al. ..... 355/3 DD
4,260,239 4/1981 Peperstraete et al. ..... 355/3 DD
4,267,796 5/1981 Kamogawa et al. ..... 355/3 DD X
4,292,387 9/1981 Kanbe et al. ..... 430/102
4,318,606 3/1982 Buholtz et al. ..... 355/3 DD

*Primary Examiner*—A. C. Prescott
*Attorney, Agent, or Firm*—Fitzpatrick, Cella, Harper & Scinto

[57] ABSTRACT

In a magnet roll comprising a plurality of magnet pieces adhesively secured to a supporting shaft, to increase the magnetic flux density of a particular magnetic pole, the magnet pieces are disposed so that they have repelling magnetic forces in the interface between the magnetic piece having said particular magnetic pole and the magnet piece adjacent thereto. Further, in a unitarily molded magnet roll comprising a unitarily molded magnet secured to a supporting shaft, the cross-sectional shape of the shaft is selected in accordance with magnetized poles, whereby the positions of the magnetic poles are prescribed relative to the shaft and a strong magnetic force is obtained.

7 Claims, 24 Drawing Figures

MAGNET ROLL

BACKGROUND OF THE INVENTION

1. Field of the Invention

This invention relates to a magnet roll for use in a developing device or a cleaning device in an image forming apparatus such as an electrophotographic copying apparatus or a facsimile apparatus or in a recording apparatus.

2. Description of the Prior Art

Developing devices of electrophotographic apparatus which use dry developer usually utilize the magnetic force of a magnet to effect conveyance of the developer to a development station and the actual development.

FIG. 1 of the accompanying drawings shows an example of the conventional developing device. An electrostatic latent image formed on the surface of a photosensitive medium 1 is developed by one-component magnetic toner 4 on a non-magnetic sleeve 3 containing a magnet roll 2 therein. The magnetic toner 4 is contained in a hopper 5 and is applied onto the sleeve 3 by a magnetic blade 6 disposed in opposed relationship with a magnetic pole N1 and is conveyed to a developing station by the rotation of the sleeve 3 in the direction of the arrow. Designated by 7 is a power source for applying a developing bias between the sleeve 3 and an electrode 8 disposed on the back of the photosensitive medium 1.

As the magnet roll 2 used for such purpose, use has heretofore been made of an isotropic or anisotropic ferrite sintered magnet. However, such a sintered magnet has required a special molding apparatus in the manufacture thereof and has been liable to break off and has greatly varied in dimensions during the sintering, and this has led to the necessity of grinding the very hard surface of the magnet after sintered. Also, the sintering reaction takes place at high temperatures, which has led to the disadvantage that a great deal of energy is consumed and the disadvantage that the magnet is very heavy.

To overcome these disadvantages, it has been proposed to unitarily shape a rubber or plastic magnet into the form of a roll and secure the roll to a supporting shaft or adhesively secure a plurality of magnet pieces to a supporting shaft and use the assembly as a magnet roll, but these proposals have not yet been put into practice because the magnetic force obtained is weak. Further, to obtain a rubber or plastic magnet having a strong magnetic force, it has been attempted to render such magnet anisotropic and in fact, it has become possible to obtain a magnet having a maximum energy product of the order of $10^6$ Gauss.Oe, but this magnet is still somewhat insufficient in magnetic force to be used as the magnet roll in the developing device of an electrophotographic apparatus or the like.

Further, in the case of a magnet roll comprising a magnet secured to a supporting shaft as described above, if the supporting shaft is a round bar or the like having a circular cross-sectional shape, the supporting shaft used must necessarily have a diameter greater than a certain value so that it may have a sufficient strength. Also, particularly in the case of a small-diameter magnet roll it is not possible to secure sufficient thickness of the magnet and it is low in permeance. Therefore, the magnetic force thereof has been weak and attempts to make the diameter of the magnet roller smaller have been hampered.

Where a magnet roll is to be formed by adhesively securing a plurality of axially extending magnet pieces a supporting shaft, if the supporting shaft is a round bar, the adhesively secured surfaces of the magnet pieces are curved surfaces and therefore, sufficient adhesion strength cannot be obtained and in particular, it has been difficult for a flexible magnet such as a rubber or plastic magnet to be adhesively secured to the supporting shaft with good accuracy.

Also, where a magnet roll is used in the developing device of an electrophotographic apparatus, particularly, in the developing device of the type as shown in FIG. 1 wherein the magnet roll is fixed and a non-magnetic sleeve is provided outside thereof and development is effected by rotation of the sleeve, it is important to properly dispose the magnetic poles of the magnet roll relative to the developing device. For this purpose, the end surfaces of the supporting shaft has heretofore been partly cut away as by milling. However, such milling has required a great deal of labor and it has been difficult to accurately determine the positions of the magnetic poles relative to the cutaway surfaces.

SUMMARY OF THE INVENTION

It is an object of the present invention to provide a magnet roll which can provide a strong magnetic force without using a sintered magnet.

It is another object of the present invention to provide a magnet roll in which a sufficient shaft strength can be obtained by changing the cross-sectional shape of a magnet supporting shaft and which has a strong magnetic force.

It is still another object of the present invention to make the magnet roll smaller in diameter.

It is still another object of the present invention to provide a magnet roll in which the positions of the magnetic poles correspond to the cross-sectional shape of the magnet supporting shaft and can be fixed by the support of the shaft without extra post-processing.

The above and other objects and features of the present invention will become more fully apparent from the following detailed description thereof taken in conjunction with the accompanying drawings.

DESCRIPTION OF THE PREFERRED EMBODIMENTS

Some embodiments of the present invention will hereinafter be described in detail with reference to the drawings.

As a plastic magnet, a high molecular compound containing 80–90 parts by weight of barium ferrite and strontium ferrite and containing as the remainder a mixture of vinyl chloride and chlorinated polyethylene ethylene acetate vinyl copolymer was heated and admixed by a roll mill and thereafter ground by a grinder to obtain a pellet. When it was extruded and made into a long-footage member, a magnetic field was applied thereto by an electromagnet, whereby there was obtained a magnet having a maximum energy product of about $1.1\times10^6$ Gauss.Oe. Use may also be made of a rubber magnet formed by mixing nitrile rubber and ferrite.

Figure 2:
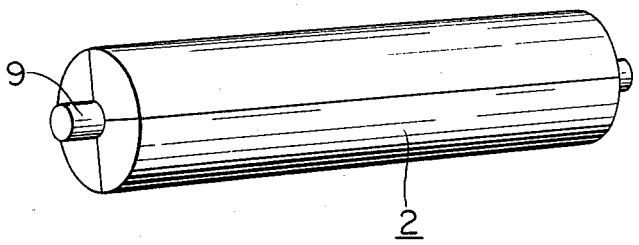
FIG. 2 is a perspective view showing an example of the adhesively secured type magnet roll.

A plurality of magnet pieces comprising such magnet were adhesively secured to a magnet supporting shaft 9 to form a magnet roll 2 having a supporting shaft diameter of 7 mm, an outer roll diameter of 25 mm and a length of 30 mm as shown in FIG. 2.

For convenience of description, the magnet supporting shaft 9 is shown as a round bar of circular cross-sectional shape.

COMPARATIVE EXAMPLE

Figure 3A:
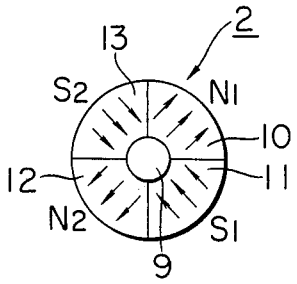
FIGS. 3A and 3B respectively are a side view of a comparative example of the magnet roll and an illustration of the lines of magnetic force therein.
Figure 3B:
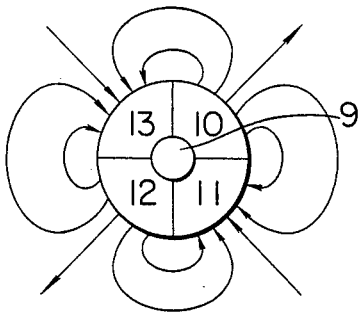

Referring to FIG. 3A which is a side view of the magnet roll 2, the magnet pieces made in the above-described manner are attached to the shaft 9 with the N and S poles thereof being alternately disposed. The arrows shown in the magnet pieces 10–13 in FIG. 3A indicate the directions of orientation of the readily magnetizable axes of the respective magnet pieces. When the magnetic flux density on the surface of the magnet roll in which the directions of orientation of the readily magnetizable axes are selected in this manner was measured, the magnetic flux density of each pole was maximum 1000 G (Gauss) which is greater than that of an isotropic magnet roll whose readily magnetizable axes are oriented at random, but it was still insufficient to be used as a magnet roll for an electrophotographic developing device. FIG. 3B shows the state of the magnetic fields.

Embodiment 1

Figure 4A:
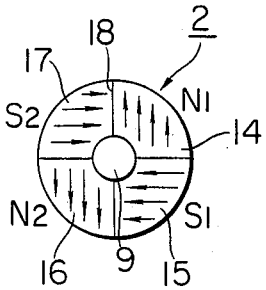
FIGS. 4A and 4B respectively are a side view of a magnet roll according to an embodiment of the present invention and an illustration of the lines of magnetic force therein.

In FIG. 4A, magnet pieces 14, 15, 16 and 17 form poles N1, S1, N2 and S2, respectively, and the readily magnetizable axes of the magnet pieces 14–17 are oriented as indicated by the arrows.

Figure 4B:
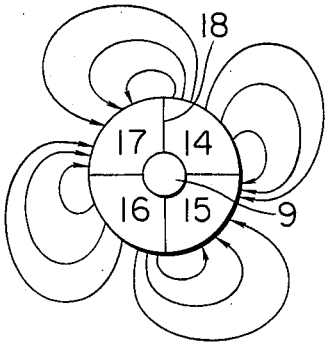

If the magnet pieces are disposed in this manner, they repel one another, but by adhesively securing these magnet pieces to one another against such repelling force, there can be obtained a strong magnetic force. That is, in the pole N1, relative to the magnet piece 14 forming chiefly the magnetic field of the pole N1, the readily magnetizable axis of the magnet piece 17 adjacent thereto is substantially orthogonal to the interface 18 between these two magnet pieces and thus, the line of magnetic force passing through the magnet piece 17 also passes through the magnet piece 14 and the effect of interpole is obtained. Such interpole effect is obtained for each magnetic pole and therefore, the line of magnetic force formed concentrates on the interface 18 side, for example, in the pole N1, as shown in FIG. 4B, with a result that a strong magnetic field is formed there. In this manner, a maximum surface magnetic flux density of 1150 G could be obtained in each pole.

Embodiment 2

Figure 5A:
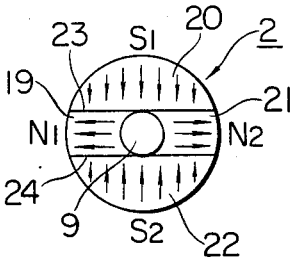
FIGS. 5A and 5B respectively are a side view of a magnet roll according to another embodiment of the present invention and an illustration of the lines of magnetic force therein.

To further enhance the above-described interpole effect, magnet pieces 19, 20, 21 and 22 were secured to one another as shown in FIG. 5A and poles N1, S1, N2 and S2 were formed in the respective magnet pieces. The readily magnetizable axes of the magnet pieces 19–22 were oriented as indicated by the arrows.

Figure 5B:
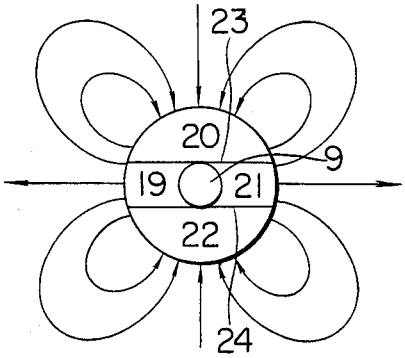

By the magnet pieces being so disposed, in the pole N1, relative to the magnet piece 19 forming chiefly the magnetic field of the pole N1, the readily magnetizable axes of the magnet pieces 20 and 22 adjacent thereto are substantially orthogonal to the interfaces 23 and 24 between these magnet pieces and therefore, these magnet pieces have an interpole effect, and the line of magnetic force concentrates on the poles N1 and N2 as shown in FIG. 5B. A maximum surface magnetic flux density of 1250 G could be obtained for the poles N1 and N2.

Figure 6:
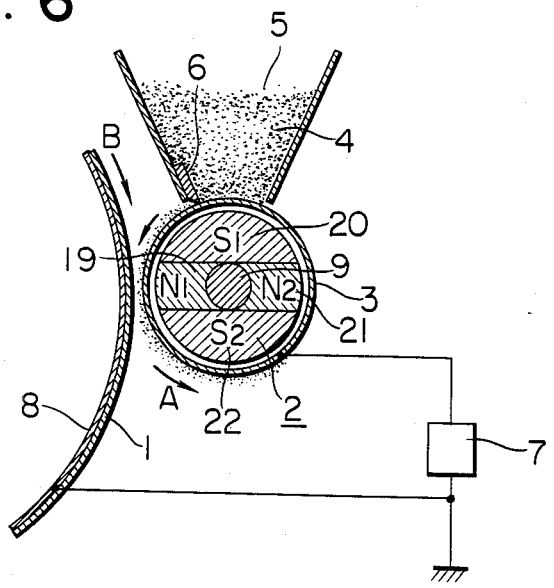
FIG. 6 is a cross-sectional view showing an example of the developing device to which is applied a magnet roll according to an embodiment of the present invention.

Also, the surface magnetic flux density of the poles S1 and S2, as compared with the case of the comparative example of FIG. 3A, is rather reduced to 800 G. Generally, however, in a magnet roll for an electrophotographic developing device, the magnetic pole fixed at the developing station requires a relatively strong magnetic flux density, but as regards the other poles, there is little inconvenience even if the magnetic flux density thereof is weak as compared with that of the developing magnetic pole. Therefore, as shown in FIG. 6, a non-magnetic sleeve 3 was attached to the outer periphery of the magnet roll 2 and, when this non-magnetic sleeve 3 was rotated in the direction of arrow A (the photosensitive medium 1 was rotated in the direction of arrow B) to cause an electrostatic latent image on the photosensitive medium 1 which is a latent image bearing member on which an electrostatic latent image is formed to be developed at a position opposed to the pole N1, there was obtained a good developed image.

Where jumping development is effected with the thickness of the toner layer on the sleeve 3 being made smaller than the shortest spacing between the photosensitive medium 1 and the sleeve 3 by the cooperation between a magnetic blade 6 and the magnetic pole S1, the alternating power source described in U.S. Pat. No.

4,292,387 or U.S. patent application Ser. No. 58,434 may preferably be used as a bias voltage source 7.

The magnetic developer used for development is not restricted to a one-component developer consisting of magnetic toner alone, but may be a two-component developer having a carrier.

Embodiment 3

Figure 7A:
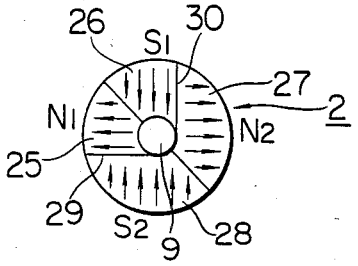
FIGS. 7A, 7B, 8A, 8B, 9A and 9B respectively are side views of magnet rolls according to further embodiments of the present invention and illustrations of the lines of magnetic force therein.
Figure 7B:
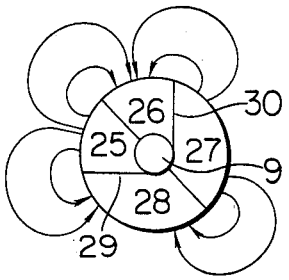

By magnet pieces 25–28 being disposed in the manner as shown in FIG. 7A, the magnet pieces 25 and 28 repel each other in their interface 29 and the magnet pieces 26 and 27 repel each other in their interface 30. The surface magnetic flux density of the poles N1 and S1 provides an interpole effect as shown in FIG. 7B by the magnetic forces of the magnet pieces 25 and 26 forming chiefly their respective magnetic fields and in addition, due to the direction of the readily magnetizable axes of the magnet pieces 28 and 27 being substantially orthogonal to the respective interfaces 29 and 30. Thus, a maximum surface magnetic flux of 1200 G was obtained for both of the poles N1 and S1. When development was effected by the use of the thus made magnet roll 2 with the pole N1 as the developing magnetic pole and with the pole S1 as the opposed magnetic pole of the magnetic blade 6 in FIG. 6, there could be obtained a good developed image.

Embodiment 4

Figure 8A:
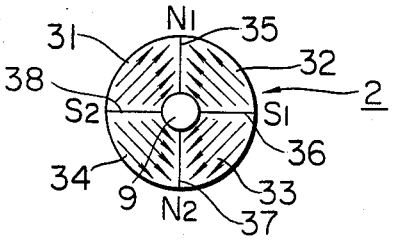
Figure 8B:
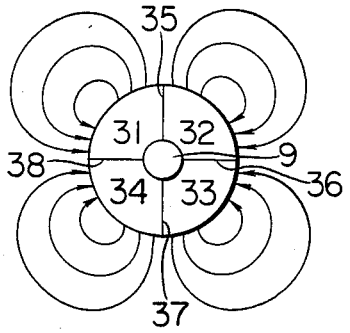

According to another embodiment of the present invention shown in FIG. 8A, magnet pieces 31–34 are disposed as shown, whereby strong magnetic fields as in FIG. 8B can be produced in the interfaces 35–38 between the magnet pieces. This is due to the fact that the respective magnet pieces are secured to one another in their interfaces 35 against their mutual repelling forces and also to the fact that the lines of magnetic force produced substantially along the directions of orientation of the readily magnetizable axes of the magnet pieces are intensified by poles N1, S1, N2 and S2. In this manner, a surface magnetic flux density of 1200 G could be obtained in each pole and thus, there was obtained a magnet roll in which the magnetic forces did not repel each other in the interfaces between the magnet pieces and the magnetic flux density pattern was as narrow as a half peak width (one half of the peak width of the magnetic flux density) as compared with the comparative example of FIG. 3 which was free of the interpole effect.

Embodiment 5

As a further embodiment of the present invention, description will be made of a small-diameter magnet roll having an outer magnet diameter of 20 mm or less. In such a small-diameter magnet roll, the magnet supporting shaft occupies a great volume ratio and this makes it very difficult to design a magnet roll containing a high molecular compound such as rubber or plastics having a magnetic flux density usable for an electrophotographic developing device. In this case, it is rather rare that all magnetic poles need be strong and therefore, by strengthening only a particular magnetic pole by suitable arrangement of magnet pieces, there can be provided a practically usable magnet roll.

Figure 9A:
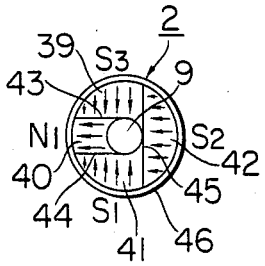
Figure 9B:
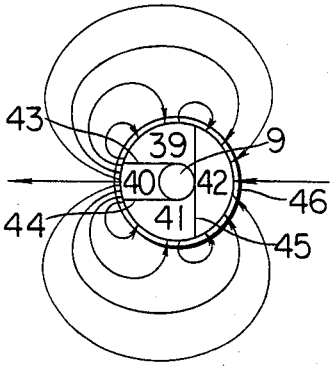

As shown in FIG. 9A, magnet pieces 39–42 were arranged and adhesively secured to one another so that the outer diameter of the magnet roll was 18 mm relative to the shaft 9 having a shaft diameter of 6 mm. The readily magnetizable axis of the magnetic material of each magnet piece was oriented as shown in FIG. 9A. In the interfaces 43 and 44 between the magnet pieces, the magnet pieces 39 and 41 are adhesively secured to the magnet piece 40 against their respective repelling forces and the readily magnetizable axis is substantially orthogonal to the interfaces 43 and 44 and therefore, the line of magnetic force passing through the magnet pieces 39 and 41 also passes through the magnet piece 40 and thus, there is obtained an interpole effect for the pole N1 as shown in FIG. 9B.

In the present embodiment, the magnet piece 42 has a pole S2 different from the pole N1 and the readily magnetizable axis of the pole S2 is orthogonal to the interface 45. Thereby, a line of magnetic force could be produced between the poles N1 and S2 to further strengthen the pole N1.

In this manner, in spite of the small diameter of the magnet roll, there could be obtained a surface magnetic flux density of 1200 G of the pole N1 and this pole N1 became sufficiently usable as the developing magnetic pole of the magnet roll for electrophotographic development. This embodiment is one in which only one pole (pole N1) of the small-diameter magnet roll is strengthened, but even in the aforedescribed other embodiments, an outer diameter of 20 mm or less is practically usable depending on the intensity of the required magnetic flux density.

The surface of the magnet roll 2 may preferably be covered with synthetic resin or the like so that the magnet pieces 39–42 after being adhesively secured to one another may not be separated from one another by the repelling forces thereof. In the present embodiment, a shrinkable tube (46 in FIG. 9A) formed of thermoplastic resin such as polyester, polyethylene or polypropylene is used to cover the surface of the magnet roll 2.

Further, in the above-described various embodiments, the adhesive agent used to secure the magnet pieces to the supporting shaft so that they may repel one another should desirably be an epoxy or rubber bond or a powerful adhesive agent called an instantaneous adhesive.

As described above, where the magnet roll is constructed so that the magnetic forces of the magnet pieces repel one another in the interfaces between the magnet pieces, concentration of lines of magnetic force occurs in the repelling portions and strong magnetic fields can be produced there. Further, by making the direction of magnetization of the magnet piece of the interpole substantially orthogonal to the interface thereof with respect to the main pole, the magnetic flux density of the main pole can be enhanced by about 15–25%. Also, in a construction wherein said magnet piece is made into an isotropic magnet whose readily magnetizable axes are substantially uniform correspondingly to the magnetized poles and the readily magnetizable axes of the magnet pieces are substantially orthogonal to the interface therebetween, a magnet roll sufficiently usable as a magnet roll for electrophotography has become obtainable even if use is made of a rubber magnet or a plastic magnet whose maximum energy product is small as compared with that of the conventional sintered magnet.

The rubber or plastic magnet used in greater in energy product and provides a greater magnetic force if it is anisotropic than if it is isotropic and therefore, an anisotropic magnet is more desirable.

However, if, as in the aforedescribed embodiments, the magnet supporting shaft to which the magnet pieces are adhesively secured is a round bar of circular cross-sectional shape, not only sufficient mechanical strength of the shaft cannot be obtained but also sufficient adhesion strength cannot be obtained because the surface of the supporting shaft to which the magnet pieces are adhesively secured is a curved surface.

Embodiment 6

Figure 10:
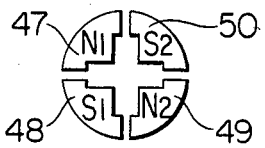
FIGS. 10 and 11 respectively are a side view of magnet pieces showing an example of the case where the cross-sectional shape of the magnet supporting shaft in the present invention is non-circular and a perspective view of the magnet roll.
Figure 11:
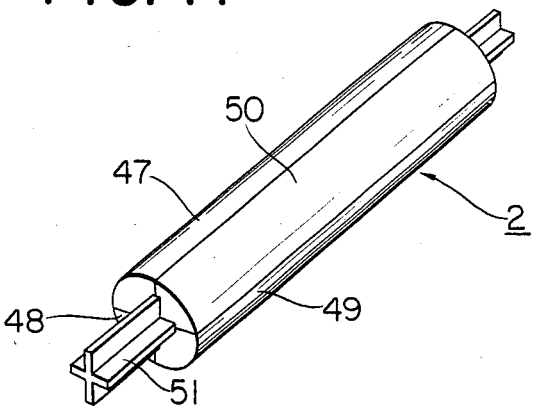

In this connection, when the plastic magnet used in the previously described embodiments was extruded and magnetized, it was molded into four magnet pieces 47, 48, 49 and 50 having cross-sectional shapes and magnetic poles as shown in FIG. 10 and these magnet pieces were adhesively attached to an iron supporting shaft 51 having a thickness of 2 mm and a width of 10 mm as shown in FIG. 11 to obtain a four-pole magnet roll 2 having an outer diameter of 16 mm and a length of 300 mm. The surface magnetic flux density of this magnet roll was about 1100 G in each pole. The direction of orientation of the readily magnetizable axis of each magnet piece of the present embodiment is as described with reference to FIG. 4A.

If it is desired to obtain a mechanical strength equivalent to that of the magnet supporting shaft 51 used in the present embodiment by a shaft of circular cross-sectional shape, there is required a shaft having a diameter of the order of 8 mm and, in that case, to obtain a surface magnetic flux density equivalent to that of the magnet roll of the present embodiment, it has been ascertained that the magnet roll obtained must have an outer diameter of 20 mm or more.

When a round bar is used as the magnet supporting shaft, the opposite ends of the shaft must be machined so that the positions of the magnetic poles may correspond to the shape of the shaft, whereas in the present embodiment, the positions of the magnetic poles can be determined correspondingly to the shape of the shaft.

Embodiment 7

Figure 12:
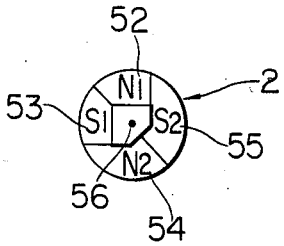
FIGS. 12 and 13 are side views of magnet rolls according to further embodiments in which the cross-sectional shape of the shaft is non-circular.

This embodiment, as shown in FIG. 12, is a four-pole magnet roll made by arranging magnet pieces 52–55 of shown cross-sectional shapes in the lengthwise direction of a shaft 56 having a pentagonal cross-sectional shape and adhesively securing them to the shaft 56. The magnet pieces 52–55 may preferably be made by extrusion-molding (or injection-molding) the aforementioned rubber magnet or plastic magnet. In this case, the magnet pieces may be magnetized after the extrusion working, but it is desirable that a magnetic field be applied to them during the extrusion working to magnetize them at one time. The direction of orientation of the readily magnetizable axis of each magnet piece is as shown in FIG. 7A.

When the magnet roll is made in this manner, the magnet pieces 52–55 are adhesively attached to the sides of the pentagonal bar shaft 56 formed of iron, whereby the adhesion of each magnet piece to the shaft becomes the adhesion between planar surfaces and thus, the magnet pieces can be accurately adhesively secured to the shaft and the adhesion strength thereof is sufficient.

Figure 1:
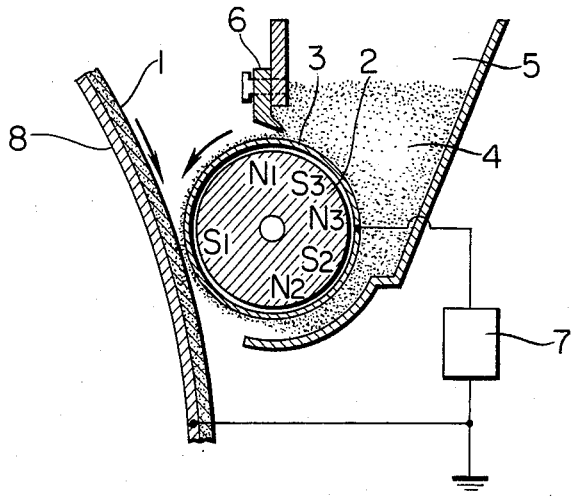
FIG. 1 is a cross-sectional view of a developing device using a conventional magnet roll.

Further, by making the cross-sectional shape of the shaft asymmetrical from first as in the present embodiment, the positions of poles N1, N2, S1 and S2 can be known more accurately from the shape of the shaft. Accordingly, where the magnet roll of the present embodiment is used in the developing device as shown in FIG. 1 or 6, the developing magnetic pole can be easily specified.

Embodiment 8

Figure 13:
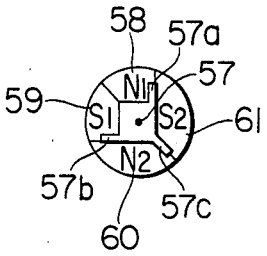

A supporting shaft 57 of cross-sectional shape as shown in FIG. 13 may be used to further enhance the adhesion accuracy of magnet pieces. That is, small projections of cross-sectional shapes as indicated at 57*a*–57*c* are provided on the shaft 57, and the magnet pieces 58–61 were adhesively attached to the shaft 57 with the magnet piece 58 abutting against the small projection 57*a*, the magnet piece 59 abutting against the small projection 57*b* and the magnet pieces 60 and 61 abutting against the small projection 57*c*, whereby each magnet piece could be adhesively secured to the shaft with accuracy of $\pm 2°$ so that the peak position of each magnetic pole was not deviated.

Figure 14:
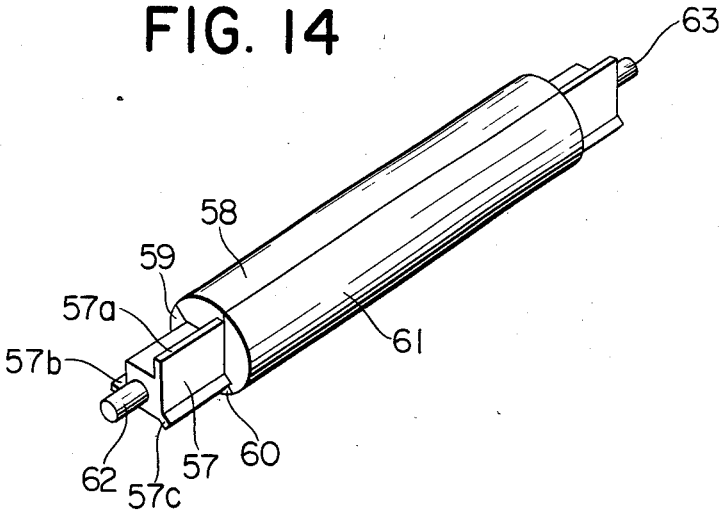
FIG. 14 is a perspective view of the magnet roll shown in FIG. 13.

The shaft of cross-sectional shape as indicated by 57 in FIG. 13 can be easily obtained with a degree of straightness of about 0.1 mm by the accuracy drawing method. Where it is necessary to receive the shaft 57 by a bearing or the like, the opposite ends of the shaft may be machined into a cylindrical shape as indicated at 62 and 63 in FIG. 14.

Thus, by adopting a magnet supporting shaft whose cross-sectional shape is non-circular at least in the portion thereof on which the magnet pieces are disposed, the thickness of the magnet at the position of the magnetic poles thereof can be secured sufficiently particularly in the case of a small-diameter magnet roll and a sufficient magnetic flux density can be obtained with a high permeance obtained. Further, the cross-sectional shape of the supporting shaft can be made to correspond to the positions of the magnetic poles, and the positional relation between the magnetic poles can be easily prescribed during the use of the magnet roll. Also, the use of the supporting shaft of polygonal cross-sectional shape leads to the possibility of easily and accurately accomplishing the adhesion of the magnet pieces to the shaft and sufficient adhesion strength can be obtained even for a flexible magnet such as a rubber or plastic magnet.

While description has so far been made of the embodiments of a magnet roll made by adhesively securing individual magnet pieces to a magnet supporting shaft, description will hereinafter be made of a unitarily molded magnet roll which is made by unitarily molding a rubber or plastic magnet and securing it to a supporting shaft and which uses a plastic magnet, for example.

Embodiment 9

Figure 15:
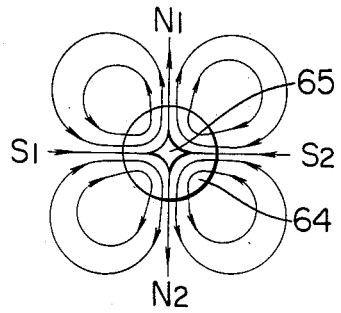
FIGS. 15 and 16 respectively are an illustration of the cross-sectional shape of and the lines of magnetic force in a magnet roll showing an example of the case where the magnet in the present invention is unitarily formed and a perspective view thereof.

As a plastic magnet, a high molecular compound containing 80–95 parts by weight of barium ferrite and strontium ferrite and containing as the remainder a mixture of vinyl chloride and chlorinated polyethlene ethylene acetate vinyl copolymer was heated and admixed by a roll mill and thereafter ground by a grinder to obtain a pellet. When it was extruded and made into a long-footage member, it was extruded so as to provide a cross-sectional shape and magnetized poles as shown in FIG. 15 while a magnetic field of $10^4$Oe$-2\times10^4$Oe was being applied thereto, to thereby form a magnet 64 having a hollow portion 65. An iron shaft of a maximum outer diameter of 8 mm having a shape as shown at 66 in FIG. 16 was fitted and adhesively secured to the magnet 64 to obtain a four-pole anisotropic magnet roll 2 having an outer diameter of 16 mm and a length of 30 cm.

Figure 16:
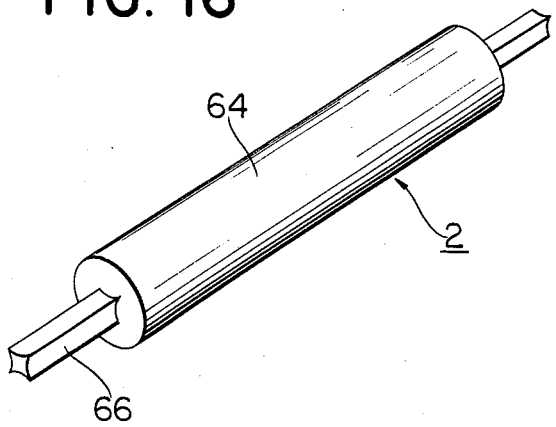

The magnet roll 2 of FIG. 16 was magnetized in the directions such as those of poles N1, S1, N2 and S2 of FIG. 15 and a surface magnetic flux density of about 1100 Gauss could be obtained for each pole.

In the magnet roll of the present embodiment, the line of magnetic force passing through each pole is as shown in FIG. 15 and the hollow portion 65 is of such a shape that it hardly affects the lines of magnetic force passing through the interior of the magnet. The readily magnetizable axis of the magnetic material of the magnet could be oriented substantially in the same direction as the shown lines of magnetic force.

If it is desired to obtain a mechanical strength equivalent to that of the magnet supporting shaft 66 used in the present embodiment by a shaft of circular cross-sectional shape, there will be required a shaft having a diameter of the order of 8 mm. In that case, the magnetic resistance of the circular hollow portion of the magnet will be great and therefore, the permeance will be so low that sufficient magnetization cannot be accomplished during the extrusion working. To obtain a surface magnetic flux equivalent to that of the magnet roll of the present embodiment, it has been ascertained that it is necessary to make a magnet roll having an outer diameter of 20 mm or more.

Figure 17:
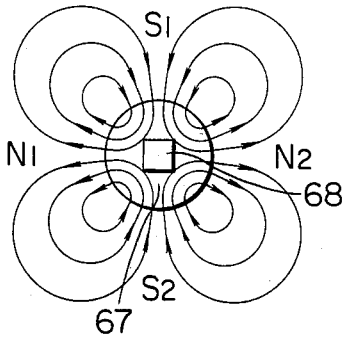
FIGS. 17 and 18 are side views of magnet rolls showing further embodiments of the unitarily molded magnet roll in the present invention.
Figure 18:
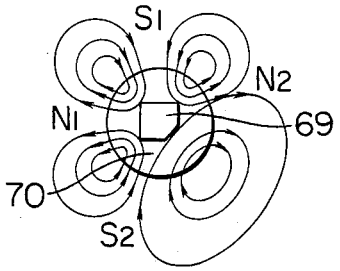

Further embodiments of the unitarily molded magnet roll are shown in FIGS. 17 and 18.

Embodiment 10

FIG. 17 shows a magnet roll made by fitting and adhesively securing a unitarily molded magnet having a cross-sectional shape as indicated at 67 and magnetized poles to a magnet supporting shaft 68 of square cross-sectional shape. This magnet roll has its four poles magnetized averagely. However, where it is desired to intensify a particular magnetic pole, for example, where it is necessary to bring the pole N2 close to the pole S1, a magnet roll which has a higher magnetic flux density at the poles N2 and S2 than a magnet roll using the shaft 68 of square cross-sectional shape and which has magnetic poles brought close to each other can be obtained by using a shaft 69 of pentagonal cross-sectional shape obtained by partly cutting away the square cross-sectional shape as shown in FIG. 18, rather than by bringing the pole N2 close to the pole N1 with the shaft shape of FIG. 17 maintained unchanged. Designated by 70 is a unitarily molded magnet.

Also, in the case of the FIG. 18 embodiment, even when the poles N1, N2, S1 and S2 must be made discriminatable, the positions of the poles N1, N2, S1 and S2 can be readily known from the shape of the shaft because the cross-sectional shape of the shaft is asymmetrical from the start.

As described above, it has become possible to obtain a unitarily molded small-diameter magnet roll having a sufficient magnetic force by using a rubber or plastic magnet. Also, by selecting the shape of the magnet supporting shaft in accordance with the magnetized poles, it has become possible to prescribe the positions of the magnetic poles relative to the shaft and obtain a strong magnetic force.

The present invention is not restricted to the magnet roll in the developing device of an electrophotographic apparatus, but is also applicable to the magnet roll of a cleaning device or other image forming apparatus or recording apparatus.

What we claim is:

1. A magnet roll comprising a magnet supporting shaft and a plurality of magnet pieces extending axially of said shaft and adhesively secured to one another and to the periphery of said magnet supporting shaft, at least one set of magnet pieces of said plurality of magnet pieces having magnetic anisotropy and the directions of the readily magnetizable axes of said set of magnetic pieces adjacent each other, respectively, being substantially orthogonal to an interface between said set of magnetic pieces.

2. A magnet roll according to claim 1, wherein said magnet is a magnet containing a magnetic material and a high molecular compound of rubber or plastics.

3. A magnet roll according to claim 1, wherein said magnet supporting shaft has a non-circular cross-sectional shape in at least the portion thereof to which said magnet pieces are adhesively secured.

4. A magnet roll according to claim 3, wherein the cross-sectional shape of said magnet supporting shaft is an asymmetrical polygon.

5. A magnet roll according to claim 3 or 4, wherein the adhesively secured surfaces of said magnet supporting shaft and said magnet pieces are planar.

6. A magnet roll according to any one of claims 3 to 5, wherein said magnet roll is covered with a shrinkable tube.

7. A developing device having a developer container for containing magnetic developer therein, a non-magnetic sleeve disposed below said developer container for supporting and conveying the magnetic developer to a developing station, a magnet roll disposed in said sleeve, and a blade for controlling the layer thickness of the developer on said non-magnetic sleeve prior to the magnetic developer being conveyed to the developing station, said magnet roll being a magnet roll formed by adhesively securing a plurality of magnet pieces to a magnet supporting shaft, at least one set of magnet pieces of said plurality of magnet pieces having magnetic anisotropy and the directions of the readily magnetizable axes of said set of magnetic pieces adjacent each other, respectively, being substantially orthogonal to an interface between said set of magnetic pieces.

* * * * *